US008123315B2

(12) United States Patent
Hägele et al.

(10) Patent No.: US 8,123,315 B2
(45) Date of Patent: Feb. 28, 2012

(54) DOMESTIC APPLIANCE COMPRISING A SUPPORT SYSTEM

(75) Inventors: Fritz Hägele, Herbrechtingen (DE); Karl-Friedrich Laible, Langenau (DE); Frank Placke, Bielefeld (DE); Ulrich Schlander, Nersingen (DE); Matthias Stahl, Schloβ Holte-Stukenbrock (DE); Ulrich van Pels, Rheda-Wiedenbrück (DE)

(73) Assignees: BSH Bosch und Siemens Hausgeraete GmbH, Munich (DE); Miele & Cie. KG, Gütersloh (DE)

( * ) Notice: Subject to any disclaimer, the term of this patent is extended or adjusted under 35 U.S.C. 154(b) by 204 days.

(21) Appl. No.: 12/525,564

(22) PCT Filed: Jan. 21, 2008

(86) PCT No.: PCT/EP2008/050657

§ 371 (c)(1), (2), (4) Date: Aug. 3, 2009

(87) PCT Pub. No.: WO2008/095766

PCT Pub. Date: Aug. 14, 2008

(65) Prior Publication Data

US 2010/0164342 A1 Jul. 1, 2010

(30) Foreign Application Priority Data

Feb. 6, 2007 (DE) ..... 10 2007 005 949

(51) Int. Cl.
*A47B 96/04* (2006.01)

(52) U.S. Cl. ..... 312/408; 108/108

(58) Field of Classification Search ..... 312/408, 312/404, 351, 405.1, 321.5; 248/235, 241, 248/243, 244, 250; 108/147.17, 106–108; 211/103, 90.02; 52/36.4, 36.5, 36.6
See application file for complete search history.

(56) References Cited

U.S. PATENT DOCUMENTS

| | | | | |
|---|---|---|---|---|
| 1,847,486 | A * | 3/1932 | Keil | 248/243 |
| 2,355,651 | A * | 8/1944 | Hormes | 248/243 |
| 2,744,714 | A * | 5/1956 | Parke | 248/245 |
| 2,747,826 | A * | 5/1956 | Fisher | 248/243 |
| 2,815,649 | A | 12/1957 | Di Angelus et al. | |
| 3,219,405 | A * | 11/1965 | Costantini et al. | 312/351 |
| 3,234,897 | A | 2/1966 | Berk | |
| 3,261,585 | A | 7/1966 | Costantini et al. | |

(Continued)

FOREIGN PATENT DOCUMENTS

| | | |
|---|---|---|
| JP | 10-243846 A | 9/1998 |

(Continued)

*Primary Examiner* — Darnell Jayne
*Assistant Examiner* — Hiwot Tefera
(74) *Attorney, Agent, or Firm* — James E. Howard; Andre Pallapies

(57) ABSTRACT

A cupboard-type domestic appliance is provided having an interior in which a height-adjustable support system is mounted. The support system includes a vertical rail provided with a plurality of snap-in recesses and a supporting arm that has a plurality of projections each of which engages with one of the snap-in recesses. The rail includes a profiled element that is immobilized on a wall via an at least one fastener and a strip is provided that can be vertically displaced in the profiled element between a position in which the at least one fastener is accessible through an opening on one side of the profiled element that faces away from the wall and another position in which the at least one fastener is concealed behind the strip.

18 Claims, 3 Drawing Sheets

U.S. PATENT DOCUMENTS

| | | | | | |
|---|---|---|---|---|---|
| 3,316,863 | A | * | 5/1967 | Zock | 108/108 |
| 3,492,766 | A | * | 2/1970 | Andrews | 52/36.6 |
| 3,647,075 | A | * | 3/1972 | Aue | 211/153 |
| 3,648,419 | A | * | 3/1972 | Marks | 52/36.6 |
| 3,730,477 | A | * | 5/1973 | Wavrunek | 248/243 |
| 3,908,320 | A | * | 9/1975 | Hogue | 52/36.5 |
| 4,212,445 | A | * | 7/1980 | Hagen | 248/245 |
| 4,244,637 | A | * | 1/1981 | Boorman, Jr. | 312/350 |
| 4,441,300 | A | * | 4/1984 | Varon et al. | 52/481.2 |
| 4,443,979 | A | * | 4/1984 | Varon et al. | 52/36.6 |
| 4,570,390 | A | * | 2/1986 | Wendt | 52/36.6 |
| 4,588,156 | A | * | 5/1986 | Doke et al. | 248/243 |
| 4,624,376 | A | * | 11/1986 | Bertram | 211/187 |
| 4,753,354 | A | * | 6/1988 | Patterson et al. | 211/26 |
| 5,004,198 | A | * | 4/1991 | Jager | 248/224.8 |
| 5,004,302 | A | * | 4/1991 | Stocking et al. | 312/408 |
| 5,074,422 | A | * | 12/1991 | Holtz | 211/187 |
| 5,185,971 | A | * | 2/1993 | Johnson, Jr. | 52/36.6 |
| 5,517,795 | A | * | 5/1996 | Doke | 52/36.4 |
| 5,803,274 | A | | 9/1998 | Scheveloff | |
| 5,927,840 | A | * | 7/1999 | Bzowski | 312/321.5 |
| 6,112,913 | A | * | 9/2000 | Rindoks et al. | 211/90.02 |
| 6,196,141 | B1 | * | 3/2001 | Herron, III et al. | 108/108 |
| 6,644,609 | B1 | | 11/2003 | Scott | |
| 7,337,730 | B2 | * | 3/2008 | Bienick et al. | 108/108 |
| 7,497,533 | B2 | * | 3/2009 | Remmers | 312/404 |
| 7,752,818 | B1 | * | 7/2010 | Roegge et al. | 52/235 |
| 7,784,626 | B2 | * | 8/2010 | Jacques et al. | 211/103 |
| 2004/0195480 | A1 | * | 10/2004 | Vardaro et al. | 248/250 |
| 2005/0150436 | A1 | * | 7/2005 | Marchetta et al. | 108/108 |
| 2006/0163985 | A1 | * | 7/2006 | Blersch et al. | 312/408 |
| 2006/0255221 | A1 | * | 11/2006 | Tseng | 248/235 |
| 2008/0030114 | A1 | | 2/2008 | Becke | |
| 2009/0195129 | A1 | * | 8/2009 | Osawa et al. | 312/209 |
| 2010/0164342 | A1 | * | 7/2010 | Hagele et al. | 312/408 |

FOREIGN PATENT DOCUMENTS

| | | | |
|---|---|---|---|
| JP | 2005-16797 | A | 1/2005 |

* cited by examiner

DOMESTIC APPLIANCE COMPRISING A SUPPORT SYSTEM

BACKGROUND OF THE INVENTION

The present invention relates to a cabinet-type domestic appliance, especially a refrigerator or freezer cabinet, with an interior in which a height-adjustable support system is installed. Such a domestic appliance is known for example from DE 10 2004 058199 A1. The support system of the domestic appliance comprises a vertical rail provided with a plurality of snap-in recesses and at least one support arm which features at least one projection engaging into one of the snap-in recesses.

A problem with this construction is that the rail is subjected by the load transferred from the support arm to significant bending moments and requires a solid anchorage on the wall in order to bear the loads occurring. A simple screw fixing of the rail to the wall is felt to be aesthetically unsatisfactory since the heads of the screws remain visible in the interior. The object of the present invention is thus to create a domestic appliance of the type specified at the start in which the vertical rail is anchored solidly but invisibly on the wall.

BRIEF SUMMARY OF THE INVENTION

The object is achieved in accordance with the invention by the rail comprising a profile element held immovably on the wall by at least one screw and including a strip able to be moved vertically between a position in which the screw is accessible through an opening formed in a side of the profile element facing away from the wall and a position in which the screw is hidden behind the strip.

If the snap-in recesses are breakthroughs in each case, the screw can be arranged to be accessible through one of the breakthroughs so that, even when it is not covered by the strip, it is unobtrusively placed.

The snap-in recesses can be formed in the displaceable strip itself.

If the snap in recesses are formed in an arm of the profile element the strip can be arranged between the wall holding the rail and the arm.

In accordance with a preferred embodiment, an opening is formed on a side of the profile element facing towards the wall and, when the screw is released, the profile element can be moved on the wall between a position in which a head of the screw passes through a wide entry section of the opening and a position in which the head is held on a narrow section of the opening. This allows the screws to be fixed to the wall even before the profile element and the profile element subsequently to be suspended on the screws. No openings then have to be made on the front side of the profile element which are wide enough to let the screw head pass through.

Preferably the snap-in recesses are arranged unobtrusively on a floor surface of a slot open towards the interior.

This slot can advantageously be undercut and the support arm can feature at least one projection held in the undercut slot. The support arm can thus not release from the rail inadvertently and after release of the projection from the snap-in recess it can be moved comfortably and securely vertically, in which case the projection glides along in the undercut slot.

The vertical rail can be attached to a door of the domestic appliance, with in this case the support arm being used to retain a door compartment; but it can also be attached in the carcass of the domestic appliance in order to be used to support compartment shelves.

Preferably two vertical rails and two support arms are joined into a rigid unit which engages into one of the rails provided in each case. If at least one of the rails features a vertical slot open to the interior into which a guide projection of one of the support arms extends, this simplifies retaining a horizontal orientation of the unit during height adjustment so that, once a desired height is reached, the projections of the two support arms engage at the same height into snap-in recesses of the strip, with a user having to pay particular attention to this aspect.

BRIEF DESCRIPTION OF THE DRAWINGS

Further features and advantages of the invention emerge from the description of exemplary embodiments given below which refer to the enclosed figures. The figures show.

DETAILED DESCRIPTION OF EXEMPLARY EMBODIMENTS OF THE PRESENT INVENTION

Figure 1:
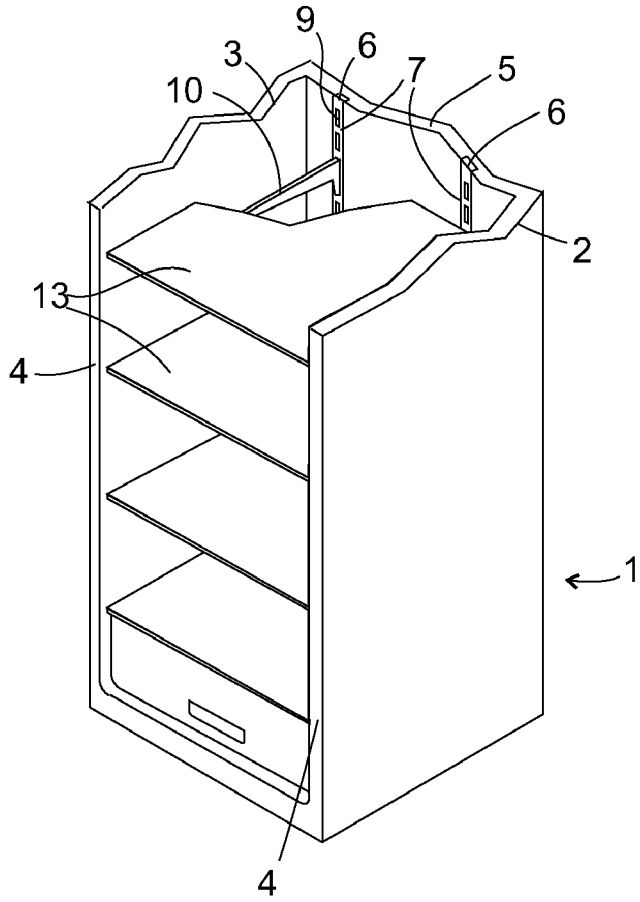
FIG. 1 a perspective, fragmentary view of a first embodiment of the inventive refrigerator.

The partly cut away refrigerator carcass 1 shown in FIG. 1 comprises in a known way an outer skin 2 joined from rigid elements such as metal sections and an inner container 3 which is delimited by walls 4, 5 filled with insulating foam material. Two vertical slots 12 are formed on the rear wall 5 of the inner container 3 (see FIG. 2) which extend over the entire height of the interior and into which hollow support rails 6 of rectangular cross-section are inserted. Hooked into the support rails 6 are support arms 10 which, as shown in FIG. 1, can support compartment shelves 13 resting loosely on them or of which two in each case can be integrated with a compartment shelf to form a rigid unit.

Figure 2:
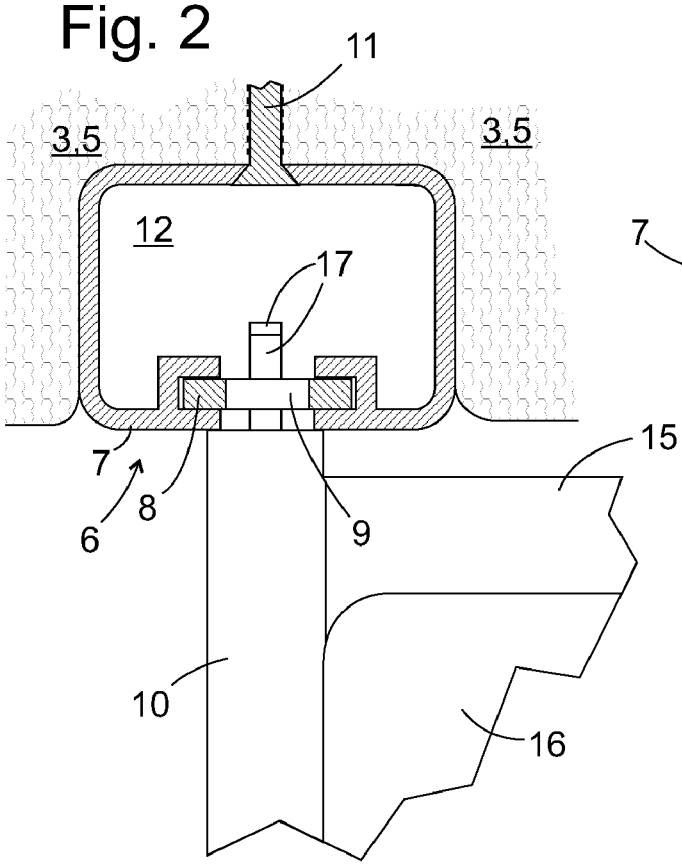
FIG. 2 a horizontal section through a vertical rail of the refrigerator and its environs.

FIG. 2 shows a horizontal section through one of the support rails 6 along a plane above a support arm 10 suspended in the support rail 6 as well as through the slot 12 of the inner container 3 accommodating the support rail 6. As shown in this figure, the two support rails 6 each comprise an outer profile 7 with an approximately C-shaped cross-section, with the open side of the C-profile facing towards the interior of the carcass 1 as well as a strip which is guided for vertical movement in two slots facing towards each other of the arms of the outer profile 7. The strip 8 is provided at regular intervals with breakthroughs 9, of which one is shown in the cross-section depicted in FIG. 2.

A support arm 10 shown as a fragment in an overhead view is provided with two hooks 17 which engage in other lower-lying breakthroughs 9 of the strip 8.

Figure 3:
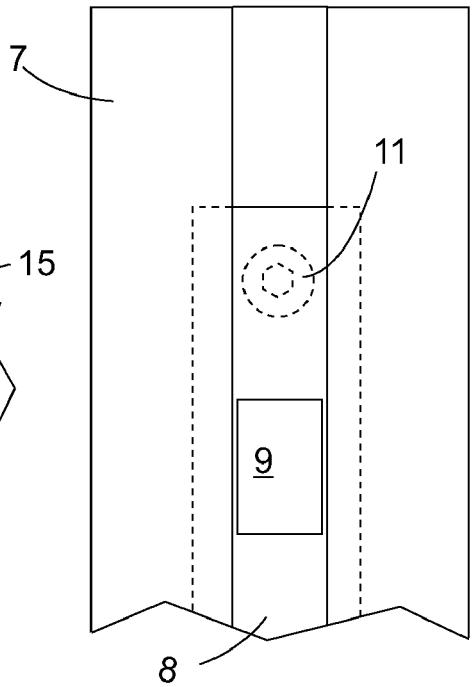
FIG. 3 a frontal view of a part of the rail.

While the outer profile 7 extends over the entire height of the inner container 3, the strip 8 is slightly shorter. As can be seen in the front view of the upper area of the support rail 6 in FIG. 3, the strip 8 does not extend right to the upper end of the outer profile 7. The strip 8 is thus able to be moved vertically in the outer profile 7 and can be raised into a position in which a screw 11 anchoring the outer profile 7 to the rear wall 5 of the carcass 1, which is shown as dashed outline in FIG. 3 because it is covered by the strip 8, is accessible through one of the breakthroughs 9. The screw 11 has a head diameter which is slightly smaller than the dimensions of the breakthroughs 9, so that, when the strip has been suitably raised, the screw 11 is introduced through the breakthrough 9 into the inside of the support rail 6 and can be introduced into a rear-side screw hole in order to anchor the support rail 6 to the rear wall 5 in this way.

In general a plurality of screws 11 is provided on each support rail in order to fix them to the rear wall 5 at a number of points distributed over their height, so that parts of the support rail 6 as a result of the torsion exerted on them by the support arms suspended from them are not deformed and project beyond the inner surface of the rear wall 5.

The screw holes on the rear side of the outer profile 7 are positioned so that in each case they are only accessible when the strip 8 is raised, whereas in the lowered position of the strip 8, when this is supported at a lower end of the support rail 6, the screw holes with the screws 11 fitted into them are hidden behind the strip 8.

The support arms 10 of a compartment shelf 13 can be embodied in each case as elements able to be suspended separately from each other in the support rails 6 which extend over a majority of the depth of the inner container 3, so that the compartment shelf can be laid loosely on top of them as indicated in the drawing depicted in FIG. 1.

In accordance with a preferred development the support arms 10, as shown in FIG. 2, simultaneously represent longitudinal bars of a frame 14 formed from two longitudinal bars and two transverse bars 15, in which a carrier plate 16, for example a sheet of safety glass, is held. The figure shows cutaway sections of the rear transverse bars 15, the left-hand longitudinal bars 10 and also the carrier plate 16 in each case.

Figure 4:
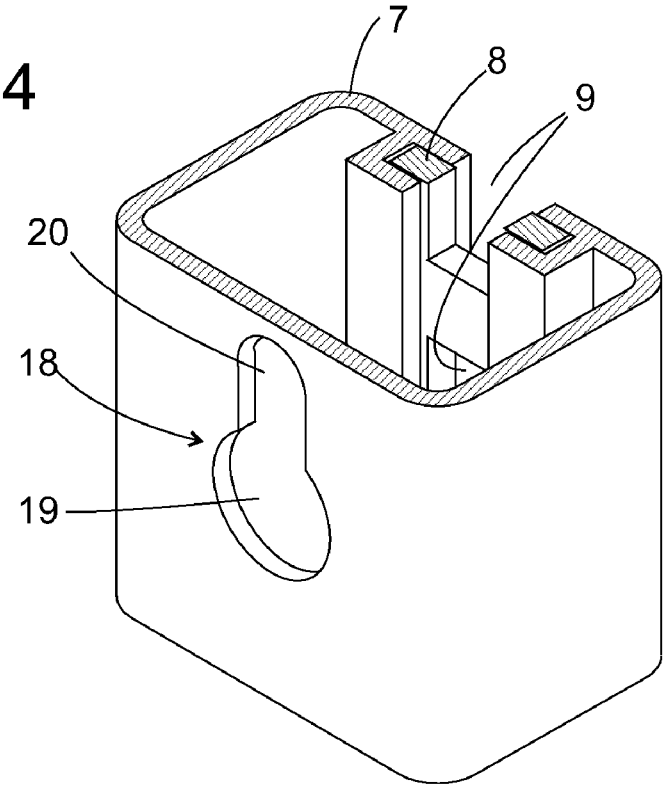
FIG. 4 a perspective view of a rail section seen from its rear side facing an inner container wall of the refrigerator in accordance with a modified embodiment.

FIG. 4 shows a preferred development of the support rail 6 in a perspective view. This support rail 6 is identical in its cross-section to the one shown in FIG. 2. Formed on the rear side of the outer profile 7 are screw holes 18 with a shape similar to that of a keyhole, which each feature a wide lower section 19 and a narrower upper section 20. The lower section 19 is dimensioned so that a head of a screw 11 used to attach the support rail 6 to the carcass 1 can pass freely through it, whereas the narrower section 20 is dimensioned in order to only let the shaft of the screw 11 pass through it. The support rail 6 is slightly shorter than the slot 12 on the rear wall 5 of the carcass 1 accommodating it. This makes it possible to install the support rail 6 by first screwing the screw 11 into the rear wall 5 then fitting the support rail 6 onto the screws 11 such that their heads fit in each case into the lower section 19 of the screw holes 18, and subsequently the support rail now lying in the slot 12 of the rear wall 5 is lowered so that the shafts of the screws 11 engage in the narrower sections of the screw holes 18. In this position the strip 8 is raised again in order to make the heads of the screws in 11 accessible and the screws 11 are tightened with the aid of a tool inserted through one of the breakthroughs 9. Since with this variant the screws 11 do not themselves have to pass through the breakthroughs 9, the breakthroughs 9 can be made narrower and also the width of the space between the two arms of the outer profile 7 guiding the strip 8 can be made narrower than depicted in the embodiment shown in FIG. 2, which improves the load-bearing capacity of the support rail 6.

Figure 5:
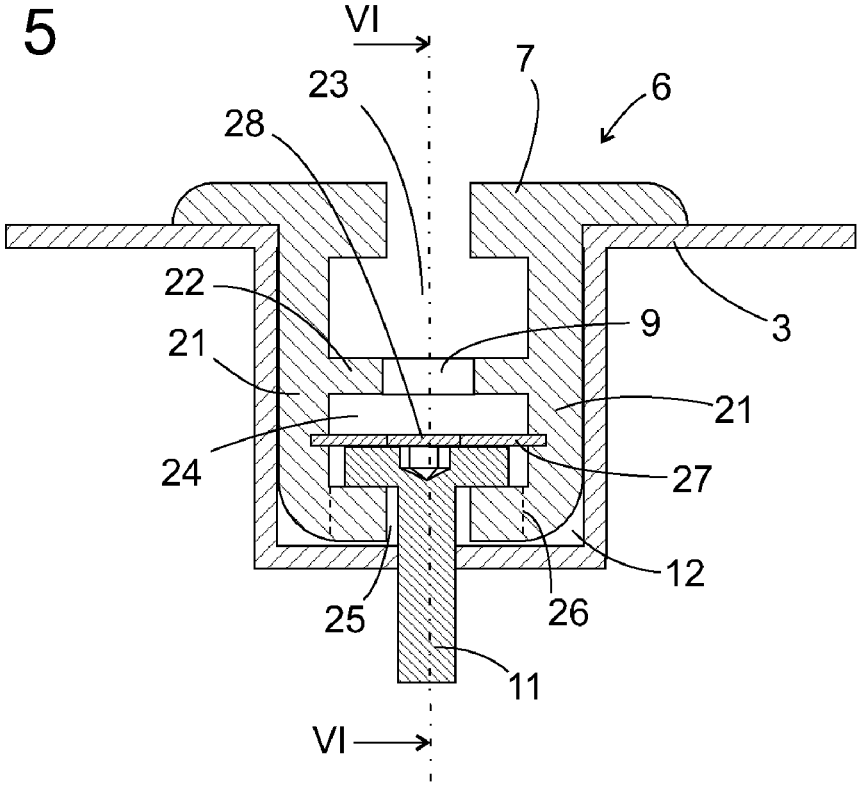
FIG. 5 a horizontal section through a vertical rail and its environs as claimed in a further embodiment.

FIG. 5 shows a horizontal section through a support rail 6 and a part of the inner container 3 on which it is installed in accordance with a further embodiment of the invention. An outer profile 7 of the support rail 6 has two parallel sidewalls 21 here which are connected to each other in the shape of an H by a crossbar 22. Breakthroughs 9 are made in the crossbar 22 at regular intervals to accept hooks of a support arm 10 not shown in the figure. The crossbar 22 forms the floor surface of an undercut slot 23 open towards the interior. A second undercut slot 24 is provided on the side of the crossbar 22 facing away from the interior.

An entry gap 25 of the slot 24 facing towards the inner container 3 has a width such that it allows a shaft but not a head of an attachment screw 11 to pass through it. Only at points on the entry gap 25, shown in FIG. 5 by dashed delimitation lines, are widened-out sections 26 created which, like the lower section 19 of the opening 18 in FIG. 4, are wide enough to let a screw head pass through them. This makes it possible to mount the support rail 6 of FIG. 5 in the same way on the rear wall 5 as described above for the embodiment of FIG. 4.

Formed in the two sidewalls 21 is a pair of opposing slits, in which a narrow strip 27 is guided for vertical displacement. The strip 27 divides the interior of the slot 24 into a rear area accommodating the heads of the screws 11 and a front area which accepts the hooks of support arms 10 extending through the breakthroughs 9.

The strip 27 is provided with a plurality of holes 28 which lie in a sunken position of the strip 27 just below a breakthrough 9 of the crossbar 22 in each case and are thus not visible from the interior of the refrigerator. The strip 27 can however be lifted into a position in which the hole 28 is flush with one of the breakthroughs 9 in each case and through this breakthrough 9 and the corresponding hole 28 the head of a screw 11 lying behind them is accessible to a tool to enable the support rail 6 to be attached to the inner container 3 or released from it. During normal use of the refrigerator closed areas of the strip 27 lie in front of the screws 11 so that none of them are visible.

Figure 6:
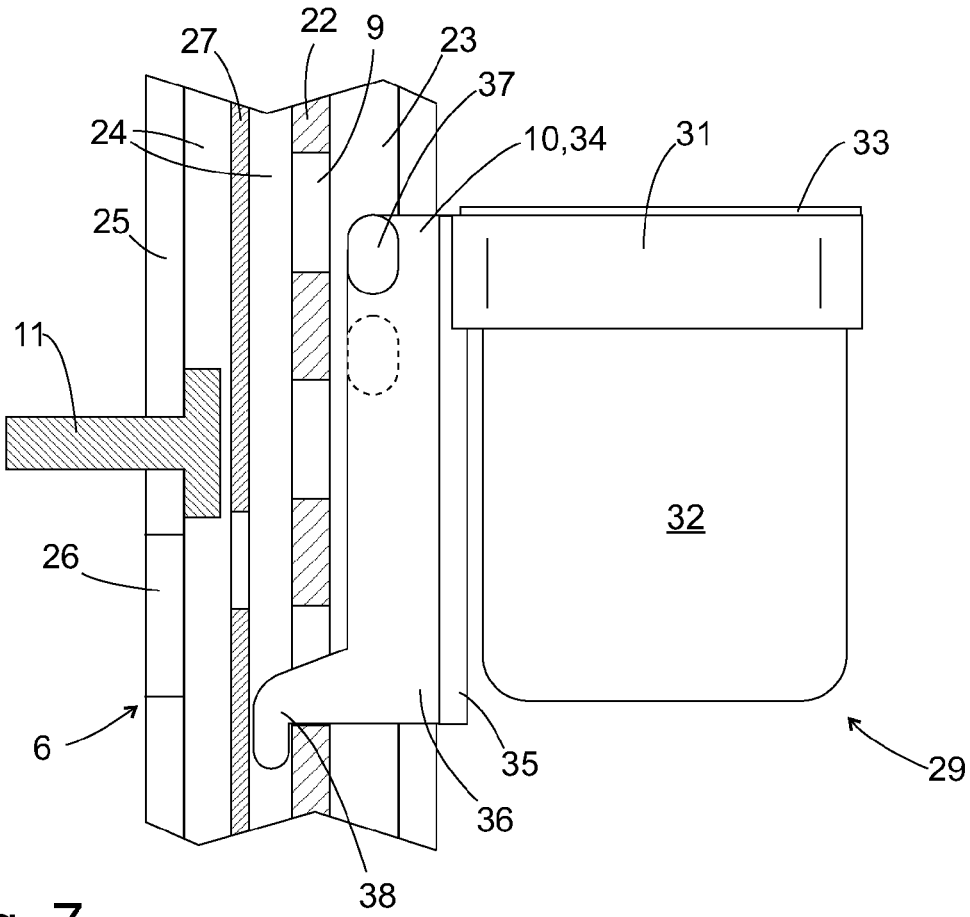
FIG. 6 a vertical section along the plane designated by VI in FIG. 5 and FIG. 7.
Figure 7:
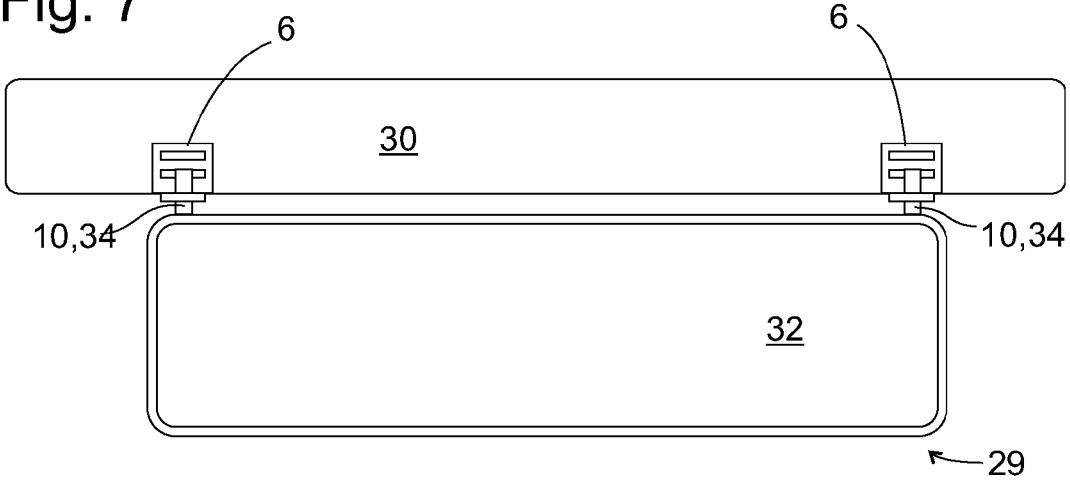
FIG. 7 a schematic horizontal section through a refrigerator door in which vertical rails of the type shown in FIG. 5 are installed.

The support rails 6 shown in FIGS. 2 and 5, can, as already specified, be mounted in the carcass 1 of the refrigerator so that support arms 10 for compartment shelves can be suspended from them; in exactly the same way however they can also be mounted on the inner side of the door so the door compartments can be suspended from them, as it shown in FIGS. 6 and 7.

FIG. 6 is a vertical section through the rail 6 depicted in FIG. 5, with a support arm 10 suspended on the rail and the door compartment 29 held by the former being shown in a side view. The support arms 10 engaging in the two support rails 6 of the door 30 are each connected rigidly here to a rectangular frame 31 in which a box 32 injection molded from plastic is loosely suspended in order to form the door compartment. A full-width lid 33 of the box lies on the frame 31.

The support arms 10 each comprise a guide body 34 with a T-shaped cross-section of with a crossbar 35 lying on the outside of the support rail 6 and a rib 36 projecting centrally from the crossbar 35 which engages into the slot 23 of the support rail 6. At the upper end of the rib 36 are formed pins 37 protruding in opposing directions which engage into the undercuts of the slot 23 in each case. Protruding from a lower end of the rib 36 is a hook engaging into a breakthrough 9 of the crossbar 22.

To change the height of the door compartment 29, it is sufficient to lift the unit slightly out of the frame 31 and support arms 10 and turn it in a counterclockwise direction in relation to FIG. 6, so that the two hooks come free from the breakthroughs 9, whereas the pins 37 remain held in the slot 23. If during pivoting it is ensured that at least the hooks 38 do not leave the slots 23, because of the rigid connection between the support arms 10 via the frame 31 it is not possible to raise or lower one of these support arms 10 significantly more than the other. A tilting of the door compartment while changing its height is largely excluded by this.

As shown in FIG. 6, the pins 37 can have a non-round cross section. It is conceivable to extend the pin 37 so greatly in a vertical direction that they restrict the ability of the unit comprising frame 31 and support arm 10 so greatly that the hooks 38 can no longer leave the slots 23. The same purpose could also be served by a number of pins arranged on the same side of the ribs 36 or on opposing sides offset in height in relation to each other, as indicated in FIG. 6 by a dashed outline 37'.

The invention claimed is:

1. A domestic appliance, in particular, a cabinet-type household appliance, the domestic appliance comprising:

at least two walls delimiting an interior of the domestic appliance; and a height-adjustable support system mounted in the interior, the height-adjustable support system including:

a vertical rail, a plurality of locating steps on the vertical rail, and at least one supporting arm having at least one projection, the at least one projection of the at least one supporting arm being engageable in one locating step of the plurality of locating steps on the vertical rail, wherein the vertical rail includes a profiled element and a moveable strip, the profiled element being fastened to a first wall of the at least two walls by at least one fastener and the profiled element having a first side that faces away from the first wall, the first side having an opening, and the moveable strip being moveably disposed in the profile element between the first side of the profiled element and the first wall and vertically displaceable in the profiled element between a first position in which the at least one fastener is accessible through the opening formed on the first side of the profiled element and a second position in which the at least one fastener is substantially concealed behind the moveable strip.

2. The domestic appliance as claimed in claim 1, wherein the at least one fastener is one of a screw and a stud.

3. The domestic appliance as claimed in claim 1, wherein the plurality of locating steps includes a plurality of snap-in recesses and the at least one fastener is accessible through one of the plurality of snap-in recesses.

4. The domestic appliance as claimed in claim 1, wherein the plurality of locating steps are formed in the moveable strip.

5. The domestic appliance as claimed in claim 1, wherein the profile element includes an arm, and wherein the plurality of locating steps are formed in the arm of the profile element, and wherein the strip is arranged between the first wall upon which the vertical rail is fastened and the arm of the profile element.

6. The domestic appliance as claimed in claim 1, wherein a mounting opening is provided on a second side of the profiled element that faces the first wall, wherein the mounting opening includes a wide entry section and a narrow section, and wherein, when the at least one fastener is loosened, the profiled element on the first wall is moveable between a first mounting position in which a head of the at least one fastener passes through the wide entry section of the mounting opening and a second mounting position in which the head of the at least one fastener is secured in the profile element by the narrow section of the mounting opening.

7. The domestic appliance as claimed in claim 1, wherein the plurality of locating steps are arranged on a floor surface of an undercut slot of the vertical rail that is open to the interior, and wherein a first projection of the at least one projection is held in the undercut slot.

8. The domestic appliance as claimed in claim 1, further comprising a door, and wherein the vertical rail is attached to the door of the domestic appliance.

9. The domestic appliance as claimed in claim 1, wherein the vertical rail is fastened in a body of the domestic appliance.

10. The domestic appliance as claimed in claim 7 and further comprising:

a second vertical rail and two supporting arms that are connected to a rigid unit, and at least one of the vertical rail and the second vertical rail has a vertical groove that is open toward the interior and into which a guide projection of one supporting arm of the two supporting arms extends.

11. The domestic appliance as claimed in claim 10, wherein the guide projection has a vertical extent of at least 5 cm.

12. The domestic appliance as claimed in claim 10, wherein the two supporting arms support a door compartment and the guide projection has a vertical extent which corresponds to a height of the door compartment.

13. The domestic appliance as claimed in claim 10, wherein the at least one projection engaging into the one locating step of the plurality of locating steps forms at least a part of the guide projection.

14. A cabinet-type domestic household appliance comprising:

a body having a plurality of walls delimiting an interior of the domestic appliance; and a height-adjustable support system mounted in the interior of the domestic appliance, the height-adjustable support system including:

a vertical rail including:

a profiled element, wherein the profiled element has a first side that faces away from a first wall of the plurality of walls and a second side that faces the first wall, wherein the first side has an access opening and the second side has a mounting opening, and wherein the second side of the profiled element is fixedly secured to the first wall of the plurality of walls by a fastener extending through the mounting opening; and a moveable strip moveably disposed in the profile element between the first side of the profiled element and the second side of the profiled element when the profiled element is fixedly secured to the first wall, wherein the moveable strip is disposed between the first side of the profile element and the first wall and vertically displaceable in the profiled element between:

a first position with respect to the access opening in which the fastener is accessible through the access opening on the first side of the profiled element, and a second position with respect to the access opening in which the fastener is substantially concealed from the access opening by the moveable strip and inaccessible through the access opening on the first side of the profiled element;

a plurality of locating steps on the vertical rail; and a supporting arm having a projection, wherein the projection of the supporting arm is engageable in a first locating step of the plurality of locating steps on the vertical rail to secure the supporting arm to the vertical rail.

15. The cabinet-type domestic household appliance of claim 14, wherein the moveable strip includes a solid portion and a portion having an opening, wherein the moveable strip is vertically displaceable in the profiled element between:

the first position with respect to the access opening in which the fastener is accessible through the access opening on the first side of the profiled element and the opening of the moveable strip, and the second position with respect to the access opening in which the fastener is substantially concealed from the access opening by the solid portion of the moveable strip and inaccessible through the access opening on the first side of the profiled element.

16. The cabinet-type domestic household appliance of claim 14, wherein the first side has a plurality of access openings and the second side has a plurality of mounting openings, and wherein the second side of the profiled element is fixedly fastened to a first wall of the plurality of walls by a plurality of fasteners extending through the plurality of mounting openings;

wherein the moveable strip includes a plurality of openings separated at regular intervals by a plurality of solid portions, and wherein the moveable strip is vertically displaceable in the profiled element between:

the first position with respect to the access openings in which each of the fasteners is accessible through a corresponding one of the access openings on the first side of the profiled element and a corresponding one of the plurality of openings of the moveable strip, and the second position with respect to the access openings in which each of the fasteners is substantially concealed from the access openings on the first side of the profiled element by a corresponding one of the solid portions of the moveable strip and inaccessible through the access openings on the first side of the profiled element.

17. The cabinet-type domestic household appliance of claim 14, wherein a length of the profiled element is greater than a length of the moveable strip.

18. The domestic appliance of claim 1, wherein a length of the profiled element is greater than a length of the moveable strip.

* * * * *